United States Patent [19]

Yang

[11] Patent Number: 4,739,783

[45] Date of Patent: Apr. 26, 1988

[54] SHORTENING LINK MEANS OF MULTIPLE-FOLD UMBRELLA

[76] Inventor: Chi-Kuo Yang, P.O. Box 10160, Taipei, Taiwan

[21] Appl. No.: 42,642

[22] Filed: Apr. 24, 1987

Related U.S. Application Data

[63] Continuation-in-part of Ser. No. 882,423, Jul. 7, 1986, Pat. No. 4,676,262.

[51] Int. Cl.[4] ..... A45B 19/00

[52] U.S. Cl. ..... 135/25 R

[58] Field of Search ..... 135/25, 20, 26

[56] References Cited

U.S. PATENT DOCUMENTS

| | | | |
|---|---|---|---|
| 3,848,740 | 11/1974 | Weber | 135/25 R |
| 3,901,257 | 8/1975 | Schäfer | 135/25 R |
| 4,007,752 | 2/1977 | Weber | 135/25 R |
| 4,030,514 | 6/1977 | Schultes | 135/25 R |
| 4,420,007 | 12/1983 | Wu | 135/25 R |
| 4,676,262 | 6/1987 | Yang | 135/25 R |

FOREIGN PATENT DOCUMENTS

| | | | |
|---|---|---|---|
| 946419 | 12/1948 | France | 135/25 R |
| 500709 | 2/1939 | United Kingdom | 135/25 R |

*Primary Examiner*—J. Karl Bell

[57] ABSTRACT

An umbrella includes ten links pivotally connected with one another and pivotally secured to a central handle of the umbrella and secured under an umbrella hood having at least three pairs of juxtaposed links each pair composed of a link formed an U-shape groove and a link rod corresponding to the U-shaped groove and operatively encased into the groove of the juxtaposed link so that all links can be folded to minimize their length and volume to be about one fifth of their extended length adapted for convenient handling and storage.

3 Claims, 2 Drawing Sheets

SHORTENING LINK MEANS OF MULTIPLE-FOLD UMBRELLA

BACKGROUND OF THE INVENTION

This invention is a continuation-in-part of an original application of Ser. No. 06/882,423 filed on July 7, 1986, now U.S. Pat. No. 4,676,262, which disclosed an umbrella having a plurality of link means and a thinning coupler operatively extended to have a generally linear configuration by the closer connection among the links and the coupler internally connected under an umbrella hood, and operatively folded to form a compact collapsible umbrella.

However, such an umbrella is vulnerably vibrated when extending the umbrella hood since all the links extended to be a generally linear configuration are majorly supported by a short second link (2) as retained on a lower bracket (93) of its central handle. Hence, the original application is merely suitable for making a three-fold umbrella, not suitable for storing into a lady handbag or any other small container for handling or storage purposes.

The present inventor has found such a defect of the original application and invented the present shortening link means of a multiple-fold umbrella.

SUMMARY OF THE INVENTION

The object of the present invention is to provide a multiple-fold umbrella, particularly a five-fold umbrella including ten links pivotally connected with cne another as secured to a central handle and secured under an umbrella hood to form at least three pairs of juxtaposed links each pair of links composed of a link formed with an U-shape groove and a corresponding solid rod snugly encased within the link with an U-shape groove so as to greatly minimize the volume of the folded umbrella, especially suitable for its storage in a lady handbag.

DETAILED DESCRIPTION

Figure 1:
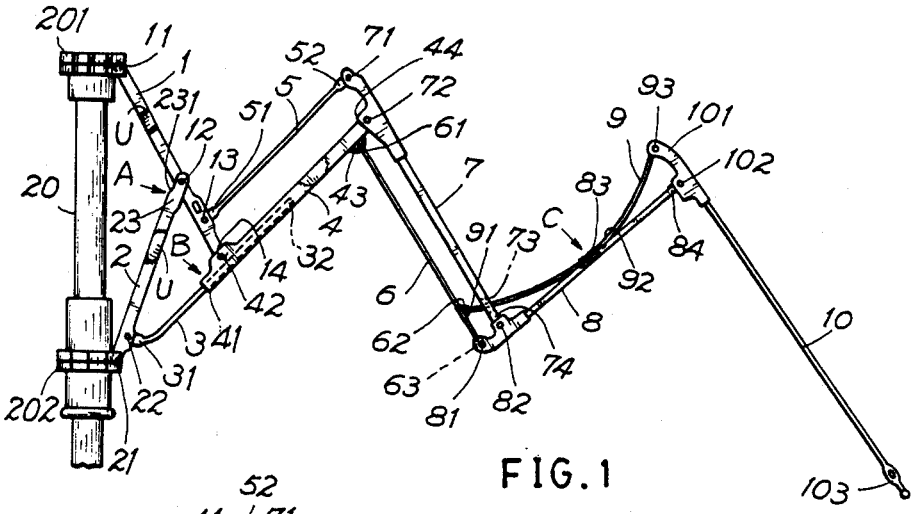
FIG. 1 is an illustration showing the present invention as partially extended.

As shown in the figures, the present invention comprises: a first link 1 having its inner end 11 pivotally connected to an upper bracket 201 jacketed on a central handle 20 of the umbrella, a second link 2 having its innermost end 21 pivotally connected to a lower bracket 202 jacketed on the central handle 20 and having its outer end 23 pivotally connected to a central portion of the first link 1 by a pin 12, a third link 3 having its inner end 31 pivotally connected with an inner portion 22 next to the innermost end 21 of the second link 2 and having its outer free end slidingly jacketed within a groove 41 formed on the fourth link 4, a fourth link 4 having a pin 42 formed proximate to an innermost end of the fourth link 4 pivotally connected with an outermost end 14 of the first link 1 and having its outermost end 44 pivotally connected to an inner portion 72 of a seventh link 7 next to an innermost end 71 of the seventh link 7, a fifth link 5 juxtaposedly formed above the fourth link 4 and pivotally secured between an outer portion 13 next to an ouermost end 14 of the first link 1 and an innermost end 71 of the seventh link 7, a sixth link 6 having its inner end 61 pivotally connected to an outer portion 43 next to the outermost end of the fourth link 4 and having its outermost end 63 pivotally connected with an eighth link 8, a seventh link 7 having its outermost end 74 pivotally connected with the eighth link 8, an eighth link 8 having an inner portion 82 next to its innermost end 81 pivotally connected with the seventh link 7 and having its outer end 84 pivotally connected to an inner portion 102 next to an innermost end 101 of a tenth link 10, a ninth link 9 having its innermost end 91 pivotally connected to an outer portion 62 next to an outermost end 63 of the sixth link 6 movably passing through a slit 73 formed on an outer portion proximate to the outermost end 74 of the seventh link 7 and having its outer end 93 pivotally connected to the tenth link 10 at position 101 and having its middle portion 92 arcuatedly bent to be slidingly held within a helical spring 83 fixed at a middle portion of the eighth link 8.

The first link 1, second link 2, fourth link 4, seventh link 7 and the eighth link 8 are each made as an U-shape grooved link having a longitudinal groove U having an U-shape cross section.

The third link 3, fifth link 5, sixth link 6, ninth link 9 and the tenth link 10 are each made as a solid rod.

The fifth link 5 is operatively encased in the U-shape groove U of the fourth link 4 when folded with each other and the link 5 is juxtaposedly formed above the link 4 as extended. The sixth link 6 is juxtaposedly positioned under the seventh link 7 as extended and the link 6 may be received into an U-shape groove of the seventh link when folded with each other. The ninth link 9 is operatively encased into the U-shape groove of the eighth link 8.

The U-shape groove of the first link 1 is open toward the fifth link 5 so that the link 5 may commonly encase the link 5 as commensurated by the fourth link 4 when folding the link means of the present invention.

Figure 2:
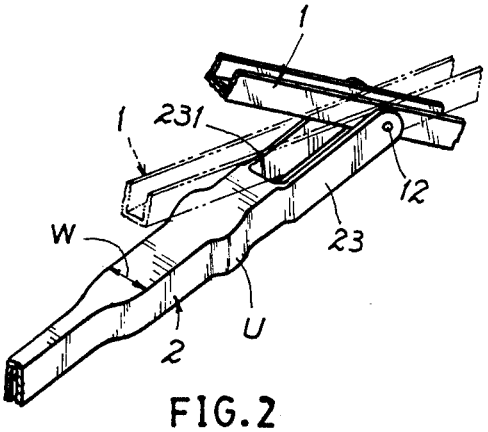
FIG. 2 shows the pivotal connection of a first link and a second link of the present invention, as viewed from direction A of FIG. 1.

The second link 2 as shown in FIG. 2 is formed with an U-shape groove U having a transverse width W wider than that of the first link 1 and the fourth link 4 so that the first link 1 and the lower portion of the fourth link 4 can be received in the U-shape groove of the second link 2 as folded; and formed with a notch 231 proximate to the outermost end 23 of the second link so that the first link 1 can be operatively retained (or clamped) within the notch 231 as shown in dotted line of FIG. 2 when extending the umbrella.

Figure 5:
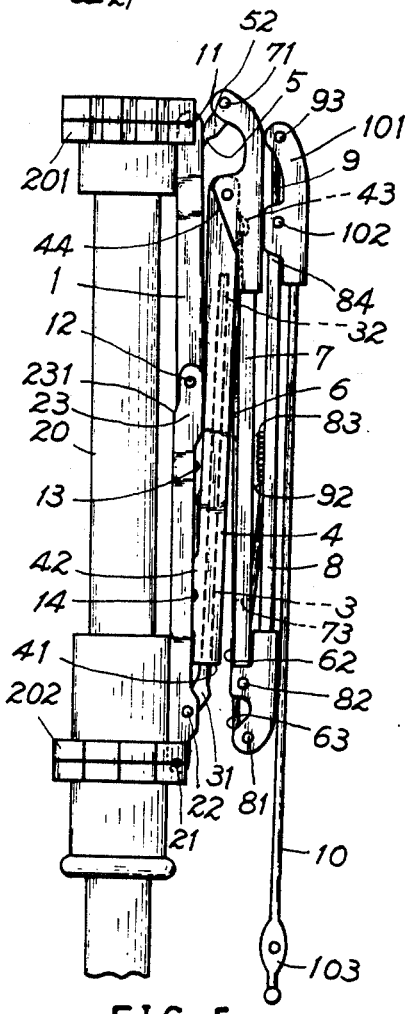
FIG. 5 is a folded illustration of the present invention.
Figure 6:
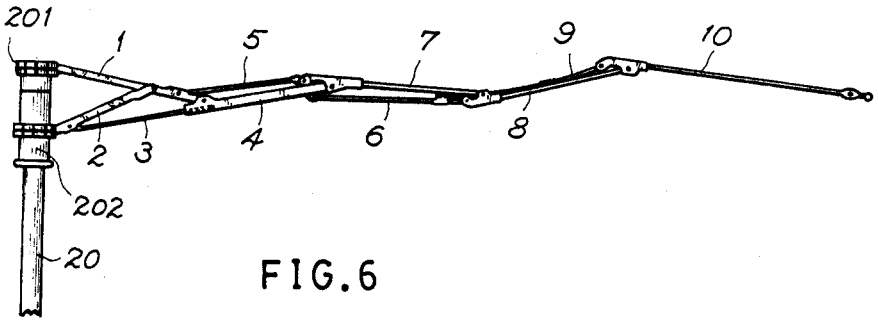
FIG. 6 shows an extended link means of the present invention.
Figure 4:
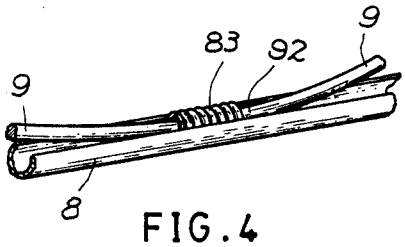
FIG. 4 shows a ninth link slidingly held in an eighth link of the present invention as viewed from direction C of FIG. 1.

The present invention can be fully extended as shown in FIG. 6 for shielding use or fully folded (5-folds) as shown in FIG. 5 for convenient handling and storage purposes. Since, it can be folded into a fifth length from its extended length as a generally linear confirguration so that the umbrella volume can be greatly reduced to be a mini compact unit, superior to the original application which can only be folded to a third of its extended length.

Figure 3:
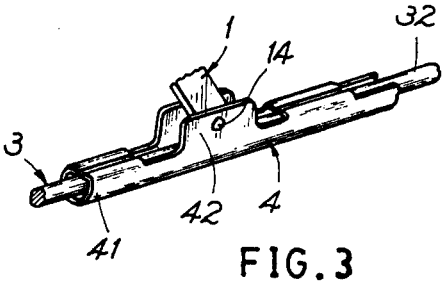
FIG. 3 shows the connection of first, third and fourth links of the present invention as viewed from direction B of FIG. 1.

Comparing the FIG. 6 of this invention with FIG. 3 of original application, the links 3, 4 of this invention have been straightened for a length about 2/5 of the extended length of the link means to thereby stably support all the links to be stronger than the original link 2 which is too short to stably support the original link means.

Even this invention has been made as a fifth-fold umbrella, it has a stronger stability than the original application when extended; but can shorten its length to be shorter than original application for more convenient uses.

I claim:

1. A shortening link means of a multiple-fold umbrella comprising:

a first link having its inner end pivotally connected to an upper bracket jacketed on a central handle of an umbrella;

a second link having its innermost end pivotally connected to a lower bracket jacketed on a central handle and having its outer end pivotally connected to a central portion of said first link;

a third link having its inner end pivotally connected to an inner portion next to the innermost end of said second link and having its outer free end movably jacketed within a groove of a fourth link;

said fourth link having a pin formed proximate to the innermost end of the fourth link pivotally connected with an outermost end of said first link and having its outer pivotally connected with a seventh link;

a fifth link juxtaposedly formed above said fourth link and having its inner end pivotally connected to an outer end next to said outermost end of said first link and having its outer end pivotally connected to the seventh link;

a sixth link juxtaposedly formed under a seventh link having its inner end pivotally connected to an outer portion of said fourth link proximate to the outermost end of said fourth link and having its outer end pivotally connected to an eighth link;

the seventh link having its innermost end pivotally connected to said fifth link, having its inner portion next to its innermost end pivotally connected to said fourth link and having its outermost end pivotally connected to an inner portion next to an innermost end of an eighth link;

the eighth link having its innermost end pivotally connected with said sixth link, having its outer end pivotally connected to an inner portion next to an innermost end of a tenth link and having a helical spring formed on its middle portion;

a ninth link having its innermost end pivotally connected to an outer portion proximate to the outermost end of said sixth link through a slit formed on an outer portion of said seventh link and having its outer end pivotally connected to the innermost end of said tenth link and having its middle portion arcuatedly bent to be slidingly held within said helical spring on said eighth link; a tenth link connected on the outermost end of said link means, whereby upon the extending of the link means as secured under an umbrella hood, a generally linear configuration of the links is formed forshielding use; and upon the folding of all links, a folded umbrella of one fifth about the extended length of the linear links is formed for convenient handling or storage.

2. A link means according to claim 1, wherein said first link, second link, fourth link, seventh link, and eighth link are each formed with a longitudinal U-shape groove having an U-shape cross section;

said first and fourth link each having its U-shape groove opened to and facing said fifth link made as a solded rod and operatively commonly encasing said fifth link when folding said umbrella; said seventh link having its U-shaped groove operatively encasing said sixth link made as a solid rod; and said ninth link made as a solid rod operatively encased in an U-shape groove of said eighth link.

3. A link means according to claim 1, wherein said second link is formed with an U-shape groove having a width wider than the width of said first and fourth link to operatively encase an outer portion of said first link and an inner portion of said fourth link within said U-shape groove of said second link and is formed with a notch proximate to the outermost end of said second link operatively retaining the middle portion of said first link when extending the umbrella.

* * * * *